United States Patent [19]

Klopf et al.

[11] Patent Number: 4,973,042

[45] Date of Patent: Nov. 27, 1990

[54] TOWER AMUSEMENT RIDE

[76] Inventors: Frank P. Klopf; Peter M. Klopf, both of 7 Rockingham Rd., Greenville, S.C. 29607

[21] Appl. No.: 468,243

[22] Filed: Jan. 22, 1990

[51] Int. Cl.[5] ..... A63G 1/00

[52] U.S. Cl. ..... 272/35; 272/18; 272/42; 272/50; 272/285; 104/79

[58] Field of Search ..... 272/16–18, 272/31 R, 30, 28 S, 32, 40, 42–45; 104/53, 55, 79, 76

[56] References Cited

U.S. PATENT DOCUMENTS

| | | | |
|---|---|---|---|
| 762,566 | 6/1904 | Webster et al. | 104/79 X |
| 932,089 | 8/1909 | Armitage | 272/50 |
| 942,759 | 12/1909 | Taylor | 104/79 |
| 1,661,864 | 3/1928 | Zabel | 272/35 |
| 1,661,865 | 3/1928 | Zabel | 272/35 |
| 1,751,096 | 3/1930 | Morris | 272/50 |
| 1,795,066 | 3/1931 | Woop | 272/32 |

FOREIGN PATENT DOCUMENTS

| | | | |
|---|---|---|---|
| 406720 | 11/1924 | Fed. Rep. of Germany | 104/76 |

*Primary Examiner*—Richard E. Chilcot, Jr.
*Attorney, Agent, or Firm*—Cort Flint

[57] ABSTRACT

An amusement ride is illustrated having an annular passenger housing (A,A',A'',A''') which surrounds a central tower (B, B', B'') and is driven relative to the tower in vertical, tilting or wobbling, and/or rotary motion by a drive arrangement (12,16,18,42,44,50). Passsenger containment units (30,64,64') carried on tracks (32) or carriage rings (60,60') are guided in a prescribed path, depending on the configuration of the annular housing, in response to the resultant motion of the annular housing. A simulated effect of annular housing (A') riding atop a geyser (F) may be provided to enhance the ride.

57 Claims, 6 Drawing Sheets

Fig. 3-A.

TOWER AMUSEMENT RIDE

BACKGROUND OF THE INVENTION

The invention relates to a new and unusual amusement park ride, particularly which involves visual and sensual simulation. Simulation is a new trend in amusement park rides. People will sit in chairs in a theater and watch a film while the chairs, or rows of chairs, move in synchronization with the action on the screen. While this is very safe and popular this type of amusement is very limited since it lacks excitement compared to many other amusement rides.

Heretofore, amusement or game devices have been proposed which use mechanisms including cables, pulleys, and winches for moving a personnel carriage in various fashions. U.S. Pat. No. 1,795,066 discloses an aquatic device having a tower, cable, and pulley wheel arrangement for raising and lowering swimmers to facilitate swimming instruction. U.S. Pat. No. 932,089 discloses a platform using a tower, cable, and pulley arrangement wherein the platform is tilted in a see-saw fashion. U.S. Pat. No. 1,661,864 discloses a tilting platform used in a mechanical toy to move cars which run around a track as it tilts. U.S. Pat. No. 942,759 discloses a tilting platform on which persons move either while upon mats that slide or in suitable cars which slide on rails. The platform is limited to tilting about a pitch axis. U.S. Pat. No. 1,558,134 discloses cars which rotate upon a track within a stationary covered tunnel with undulations provided by the track. U.S. Pat. No. 438,315 discloses an amusement apparatus having a rotating tilting platform suspended from a center pole on which passengers are seated. However, none of these devices provide an apparatus which is suitable and satisfactory for a major amusement park ride.

Accordingly, an object of the invention is to provide a major amusement park ride in the form of a tower amusement ride in which persons experience excitement through vertical and/or random movements, as well as simulation effects.

Another object of the invention is to provide a tower amusement ride having a hollow annular shaped passenger compartment which moves vertically with respect to the tower and wobbles to provide simulation and excitement.

Yet another object of the invention is to provide a passenger compartment having individual chairs carried on tracks which surround a central tower which moves vertically and rotationally relative to the tower to provide simulation and movement to the passengers seated in the chairs within the compartment.

Another object of the invention is to provide a central tower amusement ride having an annular shaped passenger compartment whose movement relative to the tower may be varied to provide desired rapid movements of chair seated passengers within the housing by means of chairs carried on tracks.

Another object of the invention is to provide a tower amusement ride wherein an annular shaped passenger compartment is moved vertically relative to the tower by means of fluid pressure or other mechanisms which simulate that the housing is being moved upwardly by water or other fluid pressure and the housing is returned under the force of gravity.

SUMMARY OF THE INVENTION

The above objectives are accomplished according to the invention by providing an amusement ride comprising a central tower, and a generally enclosed annular passenger housing surrounding said central tower. Movable passenger containment units are carried by the annular housing for containing and carrying passengers. A track or carrier ring guides the passenger containment units for movement along a prescribed path relative to the housing. A drive is provided for raising and lowering the annular housing along a tower and imparting a wobbling motion to the annular housing in at least two degrees of freedom as it ascends and descends along the height of the tower. The drive may be constructed and arranged to provide for wobbling of the housing in vertical tilting and rotary motions having three degrees of freedom. A helix may be formed between the tower and the annular housing to cause the annular housing to rotate relative to the tower as it moves vertically relative to the tower. The helix may comprise a selectively engageable follower which is operatively connected between the tower and annular housing by which the annular housing may ascend in a non-rotary motion when disengaged and may descend with a rotary motion relative to the tower when engaged. An external simulation effect may be provided for simulating a visual representation that the annular housing is dancing atop a visible fluid medium during the ascending and descending motions. The annular housing may be made quite advantageously as two concentric annular members where one annular member is suspended concentrically from the central tower, and the other annular member rotates relative to the other annular member. In this case, the passenger containment units may be fixed or pivotably mounted to the other annular member. The suspended annular member is driven in a prescribed manner to cause the other annular member and passenger containment units to have a resultant movement.

DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein:

FIG. 3A is a partial sectional view of an alternate embodiment of an annular housing for a tower amusement ride according to the invention;

DESCRIPTION OF A PREFERRED EMBODIMENT

Figure 1:
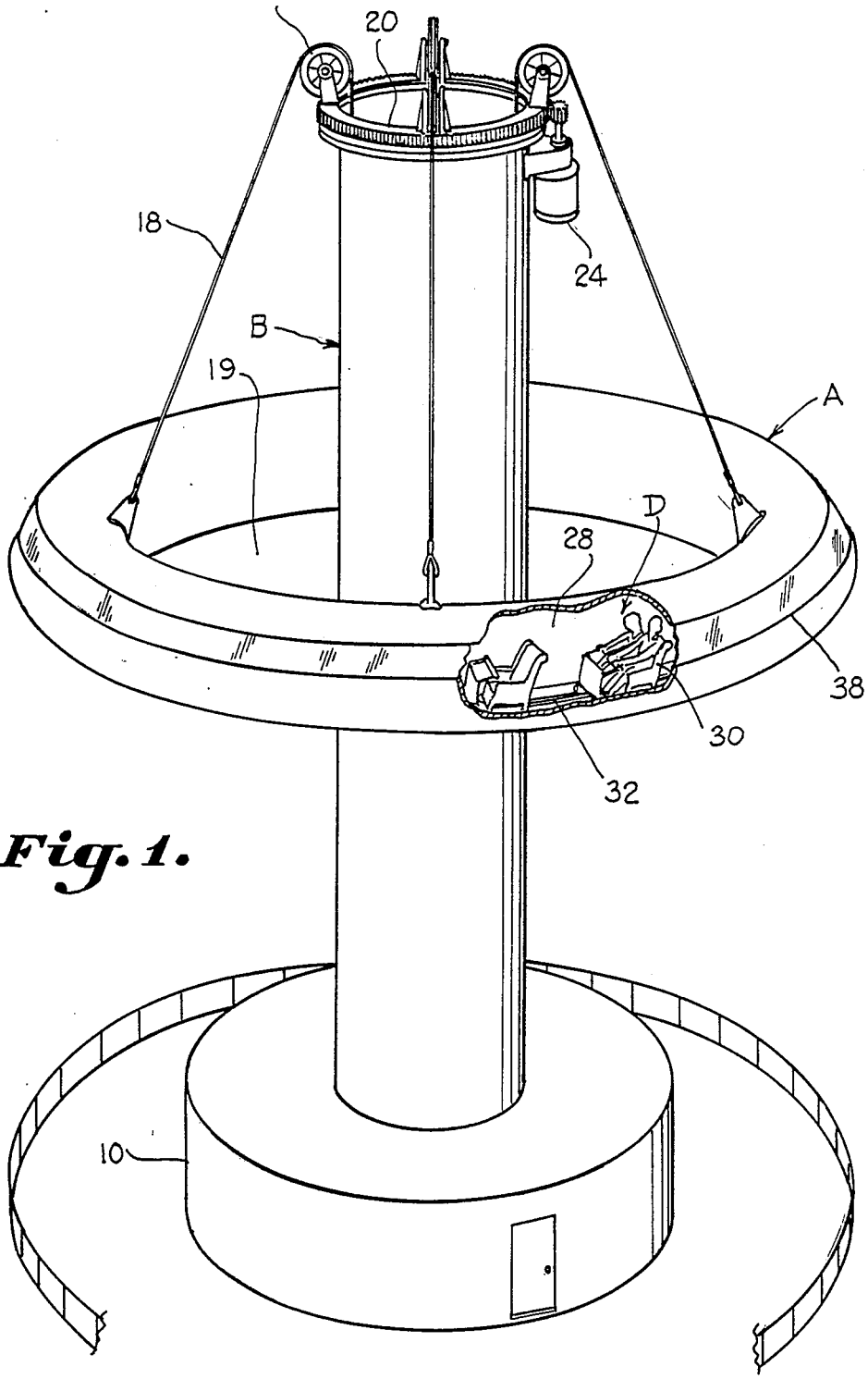
FIG. 1 is a perspective view of a tower amusement ride constructed according to the present invention.
Figure 2:
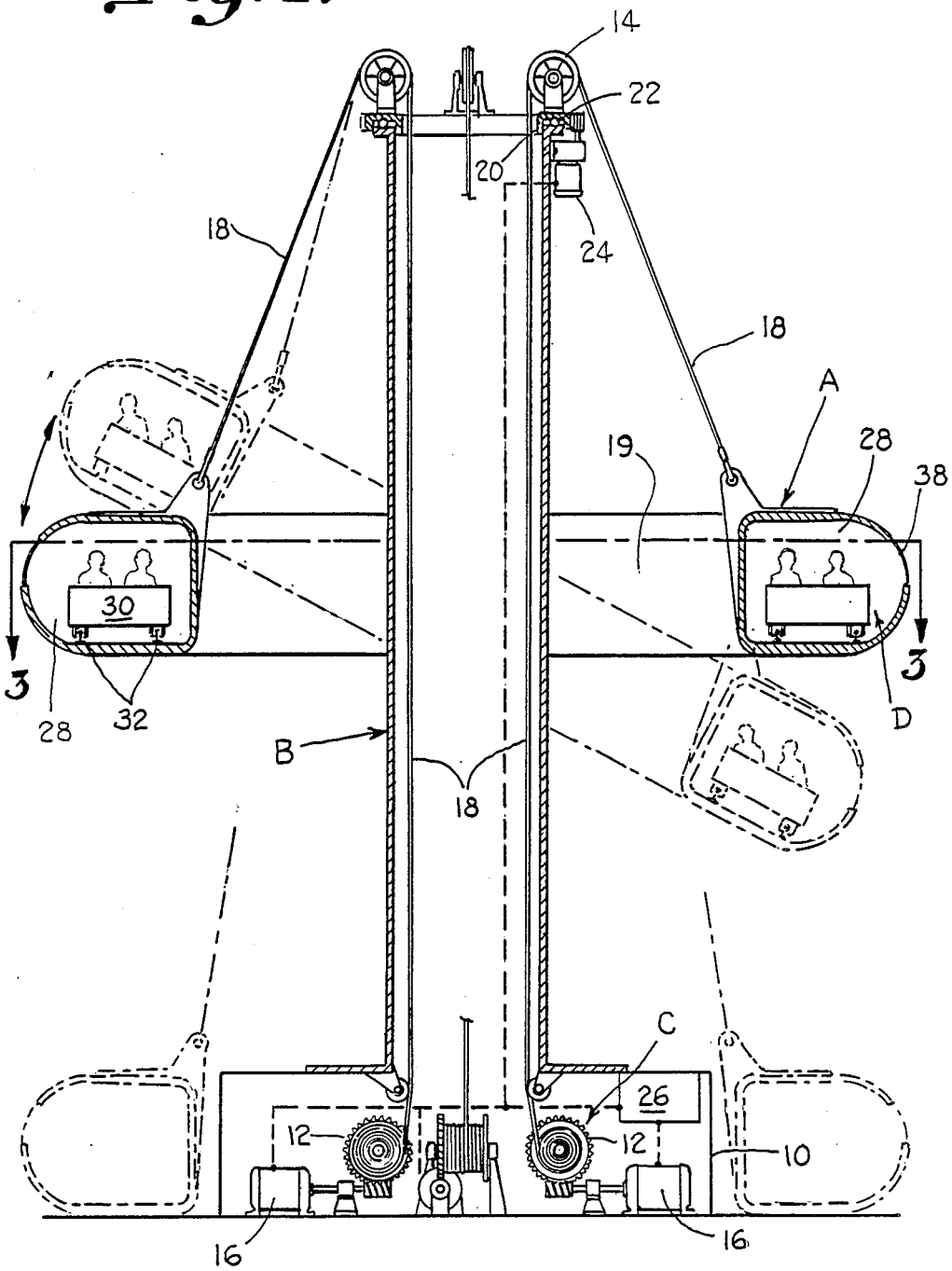
FIG. 2 is a section view illustrating a tower amusement ride of FIG. 1 according to the invention.
Figure 3:
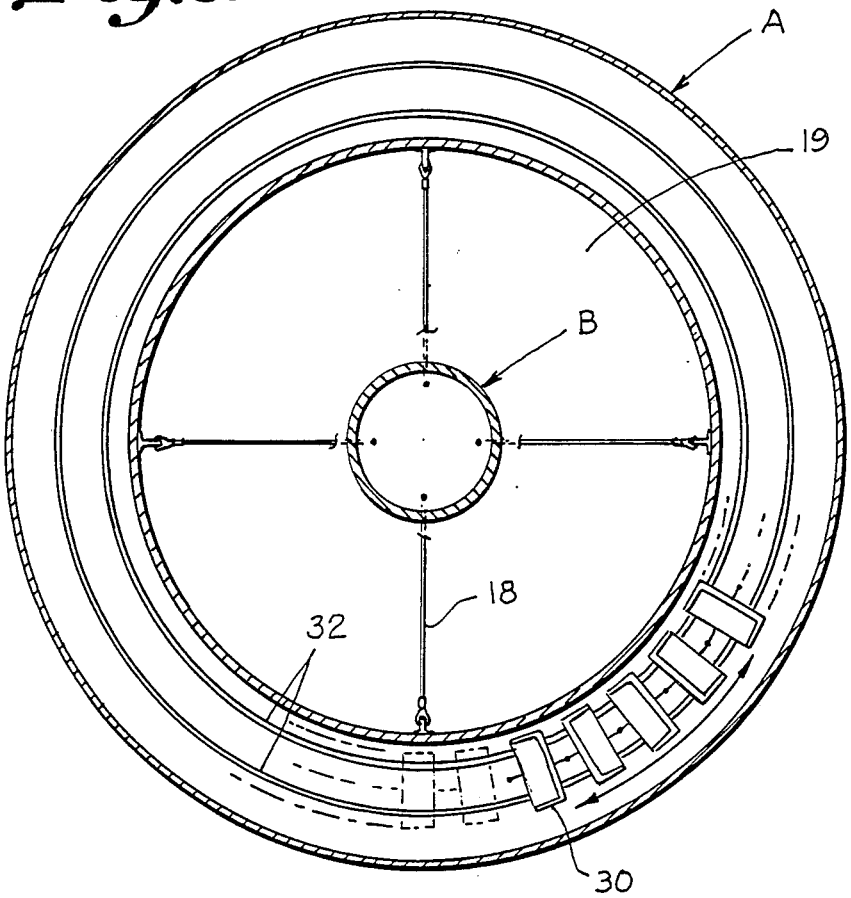
FIG. 3 is a sectional view of an annular housing for an amusement park ride constructed according to the invention.
Figure 3:
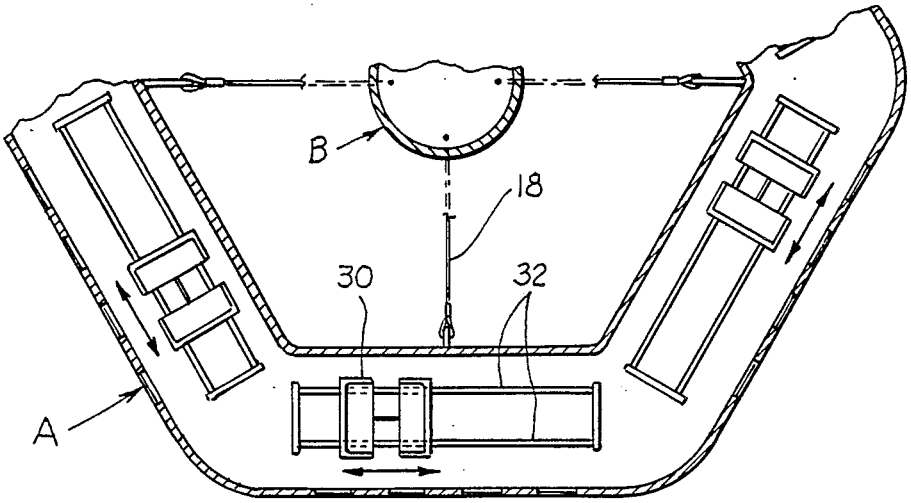

Referring now in more detail to the drawings, as can best be seen in FIGS. 1 and 2, an annular passenger housing A is disclosed which may be either circular or polygonal (FIGS. 3 and 3A). Annular housing A is carried concentric with a tower B carried on a suitable base 10. Drive means C is provided for moving annular housing A vertically relative to tower B comprises a plurality of winches 12 mounted equiangularly (FIG. 2). The vertical movement may occur over any desired operational height of tower B along which it is desired to operate the ride. On top of tower B is a plurality of pulley wheels 14 which are also spaced equiangularly around the tower. Preferably, there are six such winches 12 and pulley wheels 14 spaced at 60degree angles relative to each other, while only four are illustrated in the drawings at a 90 degree placement for ease of illustration. Winches 12 may be motorized by any suitable means as indicated at 16. Connector means for connecting annular housing A, tower B, and the drive means may include generally flexible cable means in the form of plural flexible strands 18 which may be any suitable cable such as braided steel cable which run in pulley wheel 14. The drive means further comprises means for rotating annular housing A relative to tower B, as well as moving the same vertically. In this case, a drive ring 20 is carried on a suitable bearing 22 in a conventional manner. A drive 24 is provided for rotating a ring 20 relative to tower B. When winches 12 are stationary, multiple revolutions of annular housing A will not be practical. However, a reversing twisting motion less than 360 degrees is effectively permitted and will be desireable for many amusement ride motions. By rotating ring 20 back and forth, twisting of annular housing A may occur as cable 18 flexes and allows this motion. The motion may have an angular extent as long as cables 18 do not twist together. Drive means C can thus be seen to impart a motion to annular housing A which is vertical, tilting, and/or rotational. Housing A can be tilted to one side and then to the opposite, as can best be seen shown in dotted lines in FIG. 2, by controlling the drive of winches 12 accordingly. It will be noted, as can best be seen in FIGS. 2 and 3, that a substantial space 19 exists between annular housing A and central tower B. This allows the drives of the winches 12 and cables 18 to be programmed and synchronized to initiate a 3-dimensional wobbling motion which includes both vertical and horizontal components. Thus, the annular housing may assume the motion of a rolling wave. Mounting of winches 12 and motors 16 may also be on a rotary driven ring, like 20, so that rotations greater than 360 degrees may be had. Preferably, annular housing A is constructed to simulate a space station and the motion imparted by programming winches 12 will produce an effect of traveling in space. An interior 28 of annular housing A may be theatrically staged inside by having moving chairs, or rows of chairs, lighting, and other staging to produce a cinema effect. The diameter and weight of annular housing can be very large and more cables can be utilized as needed. However, at least three cables and drives need to be utilized for stability. While housing A is illustrated as closed, the housing may also be open, at least in part, while it is preferred that the housing be continuous 360 degrees about tower B.

An interior 28 of annular housing A includes passenger containment means D for containing passengers at an identifiable station in a desired manner. As illustrated, passenger containment means D comprises a plurality of individual cars 30 which ride on railroad like tracks 32. The tracks may be arranged in one of two configurations. Where annular housing A is circular (FIG. 3), tracks 32 can be continuous and run around the entire circumference of interior 28. Where annular housing A is a polygon (FIG. 3A), tracks 32*a* may terminate at each vertices of the polygon. In either the circular or polygonal configuration, individual cars 30 may be linked together so that there is a spacing between them that is fixed and they move like a train on tracks 32. Alternately, the cars may not be linked together and thus move independently of each other. A continuous circular annular housing is particularly advantageous because a continuous ring rail may be used with fixed or swivel mounted passenger compartment units or chairs, as will be described in connection with FIGS. 8 and 9. During the amusement ride, annular housing A, in the form of a space station or other simulation, may tilt up and down in an omnidirectional wobbling motion producing a resultant motion which causes cars 30 inside annular housing A to move along tracks 32 in response to the movements. Motion of the containment units will be initiated by one moving part (cars 30, or rings 60, 6') being heavier than the rest which is always pulling the moving part with passengers to the lowest point. While a cable/pulley and winch drive arrangement is illustrated, it is to be understood, of course, that other means for driving annular housing A may be provided which is constructed and arranged to move the housing so that passenger cars 30, are caused to move on the tracks in a desired manner. Special construction of the track or other guide means for the passenger containment means in the form of cars 32 may also be had to achieve a desired movement of the cars inside the housing in response to the external movement of the housing as acted upon by external drive means, particularly in combination to the following alternate embodiments.

Figure 4:
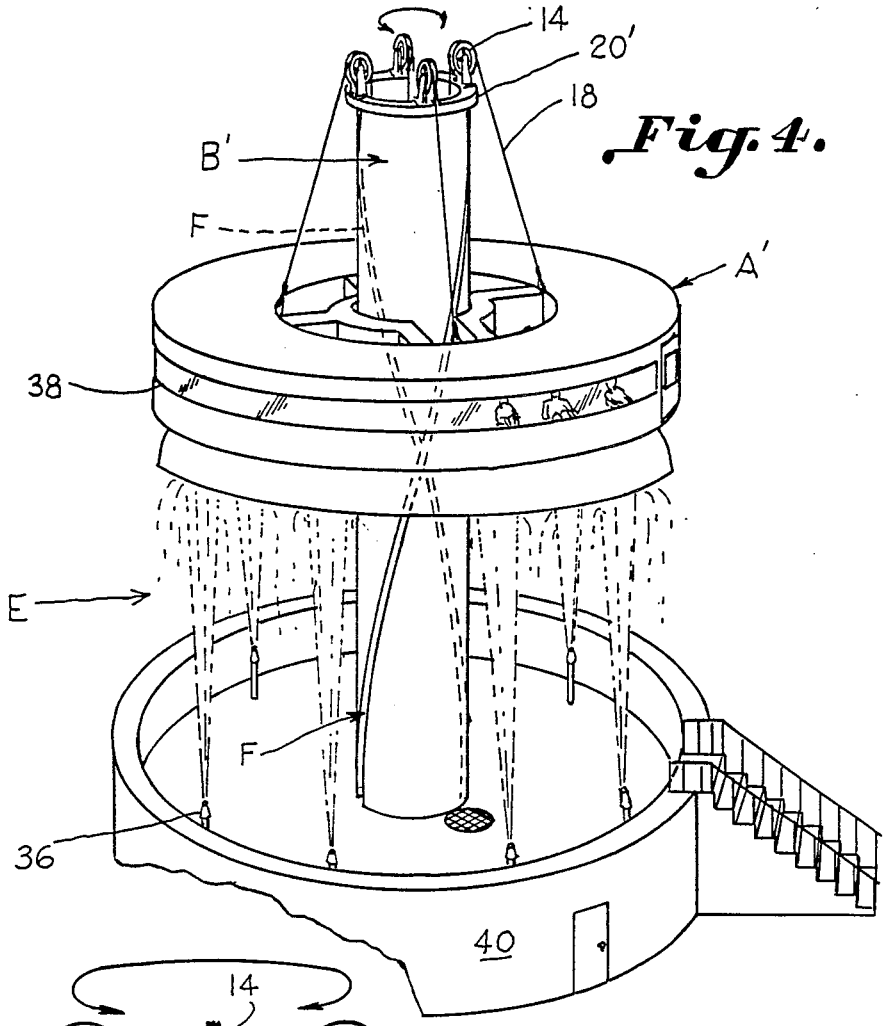
FIG. 4 is a perspective view of an alternate embodiment of a tower amusement ride according to the invention.
Figure 5:
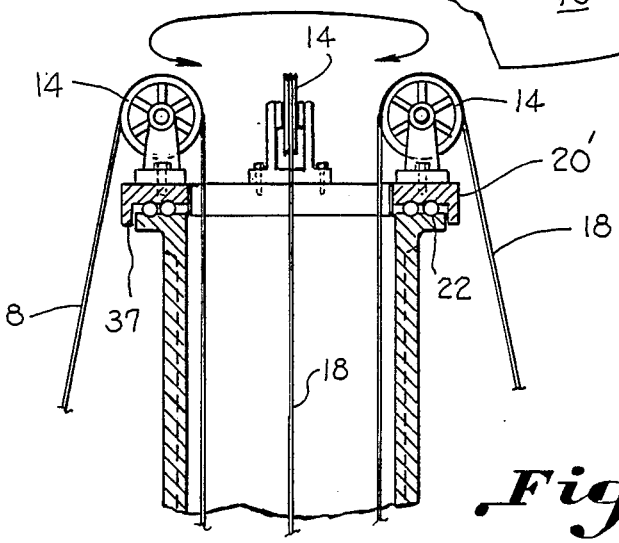
FIG. 5 is a sectional view taken along line 5—5 of FIG. 4.

As can best be seen in FIG. 4, an alternate embodiment of the invention is illustrated which includes simulation means E for simulating a water fountain or geyser effect raising annular housing A'. As illustrated, the simulation means comprises a plurality of water jets 36 spaced underneath and about annular housing A' to produce the desired effect. By programming the fountains in synchronization with the movements of annular housing A', a visual representation will be created that annular housing A' rides on top of the fluid jets which may be made to simulate either a water fountain or a naturally occurring geyser. The simulation further creates the impression that the annular housing is rising under the force of the fountain or geyser. This may be advantageous in many applications where annular housing A′ is provided in a form other than a space station. Windows 38 in the annular housing further enhance the visual effects and motion simulation by allowing the passengers to see the outside environment. This provides a reference to the passenger which further enhances the effect of the motions of the annular housing as it moves vertically, tilts or wobbles, and/or rotates. In this embodiment, a pedestal base 40 is provided upon which annular housing A′ rests above fluid jets 36.

As can best be seen in FIG. 4, helix guidance means F for providing rotational guidance to annular housing A′ is illustrated which includes a helix groove 42 formed in tower B′ and a follower means 44, which may be a key, roller, or other follower, carried by annular housing A′, and rides in helix groove 42. As can best be seen in FIG. 7, the helix follower may be a follower which is fixed instead of a retractable follower 44′ as illustrated in connection with the embodiment of FIG. 6. Cable pulleys 14 are carried by a freely rotatable ring 20′ which rides the top tower B′. As cables 18 raise annular housing A′, helix means F causes housing A′ to rotate twisting the cables 18, but not crossing the cables as to interfere adversely with each other. For this purpose, pulley wheels are carried on a rotating, but non-driven ring 20′. Housing A′ may move vertically up and down several times during the ride and have the visual effect of dancing up and down on geyser E while moving in reversing rotational motions under the guidance of helix F. Housing A′ may include a collar structure 48 which is guided over tower B′ and maintains follower 44 in a tracking relation in groove 42.

Figure 6:
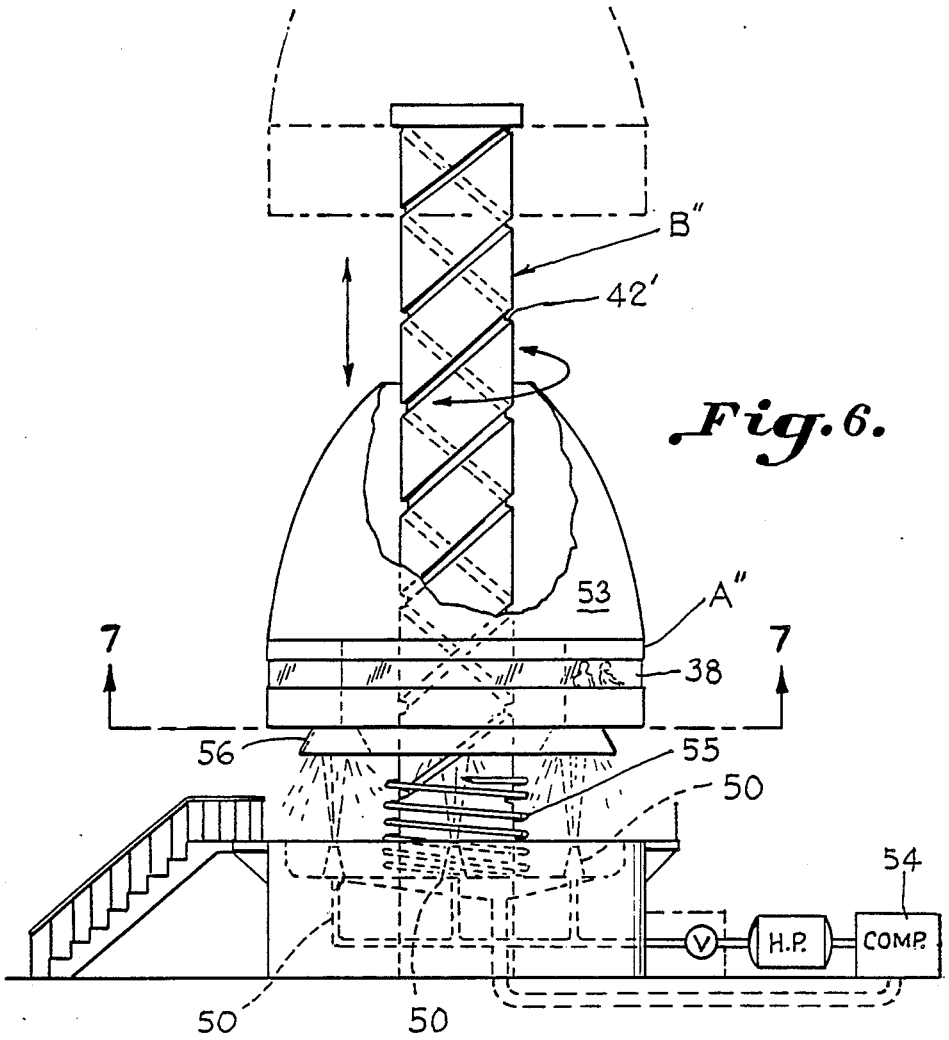
FIG. 6 is an elevation of an alternate embodiment of a tower amusement ride constructed according to the present invention.
Figure 7:
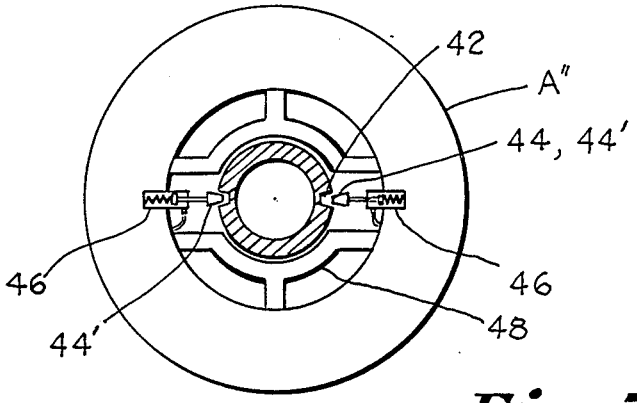
FIG. 7 is a sectional view taken along line 7—7 of FIG. 6.

Another embodiment of the invention is illustrated in FIG. 6 wherein fluid nozzles 50 provide a drive means in the form of fluid pressure and are circumferentially spaced around a base 52 of an amusement ride which includes housing A″ concentrically carried about tower B″ having a dome 53. In this case, the cable drive means is omitted and the amusement ride is considerably reduced in its size and duration. Housing A″ and dome 53 resemble a bullet. The ride may consist of the bullet shooting upwards in its ascent in pure vertical motion, and spinning rapidly as it descends with the rotation imparting helix engaged. In this case, compressed air or water may be utilized to push housing A″ vertically upwards against gravity. Means for assisting in the start of the upward vertical movement of housing A″ is provided by a biasing means in the form of a spring 55 which offsets the weight of the housing to facilitate the start. Means for pressurizing the air or water is provided by a compressor 54 connected to a source of fluid (not shown) which is compressed by the compressor and forced through the jet source 50 against a shield 56. Follower means 44′ is preferably formed by retractable key followers (FIG. 7) so that the followers may be retracted during the ascent of housing A″ so that housing A″, does not rotate during the ascent. Prior to descent, however, the followers are extended causing rotation to be imparted to housing A″ as it descends and engages and travels along helix groove 42′. For this purpose, helix groove 42′ may be designed to provide many rapid revolutions to housing A″ as it descends under the force of gravity. Followers 44′ may be actuated by admission of fluid to a spring biased fluid cylinder 46. Cylinder 46 may be under the control of a programmed controller or be manually controlled. Advantageously in this case, the helix may be disengaged during the ascent so that the force required to raise housing A″ vertically is reduced. Prior to descent, the helix is engaged so that a rapid spinning motion is imparted during the descent. Because there is no cable drive, housing A″ may be driven so as to rotate many revolutions and helix 42′ is designed to accomplish this, as opposed to the helix 42 which limits rotation to less than a revolution. Either fixed or movable passenger containment means may be provided inside annular housings A′ and A″, for example, moving cars (FIG. 1) or seats (FIGS. 9 and 10).

Figure 8:
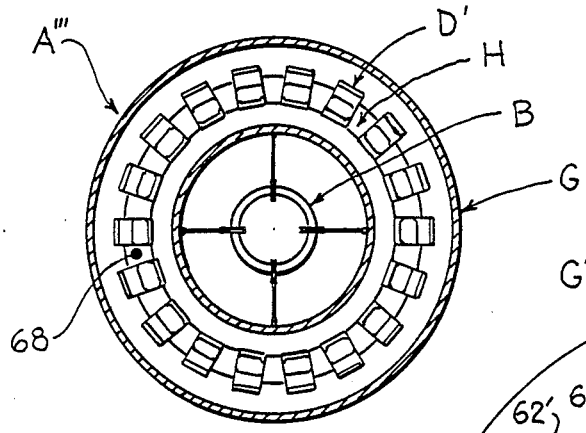
FIG. 8 is a top plan view of another embodiment of an annular passenger housing constructed in the form of a pair of concentric annular members, one of which rotates relative to the other in accordance with the invention.
Figure 10:
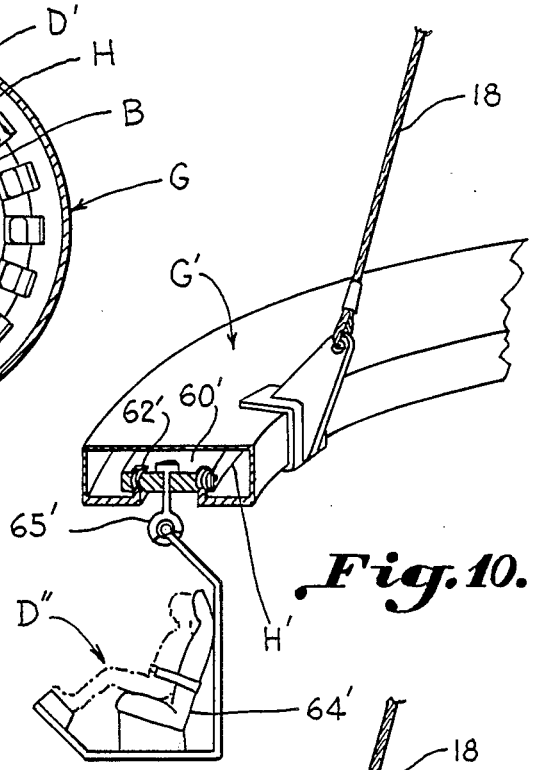
FIG. 10 is a sectional, partial cut away view of another embodiment of the invention according to FIG. 8.
Figure 9:
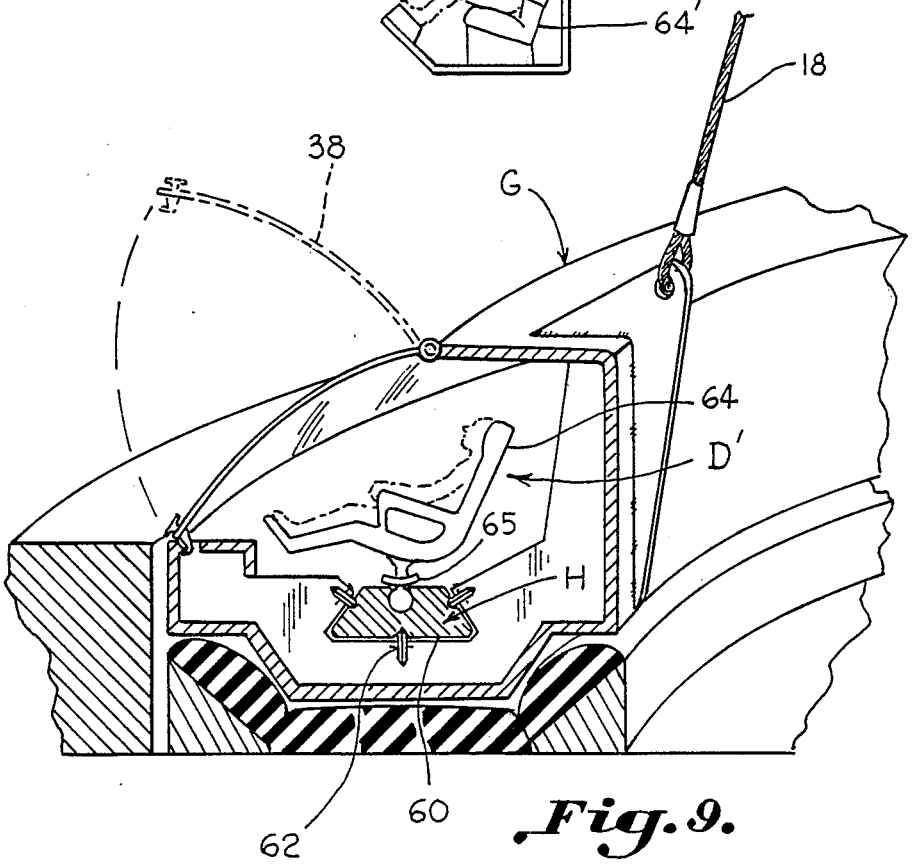
FIG. 9 is a sectional, partial cut away view illustrating an embodiment of the invention according to FIG. 8.

Referring now to FIGS. 8, 9, and 10, other embodiments of the invention will be described wherein the annular passenger housing is provided in the form of an annular passenger carrier A‴ having a pair of concentric annular members G and H which may slide relative to one another (FIG. 8). Annular member G is carried by cables 18 and annular member H, which is in the form of a carrier ring 60, is slidably carried by annular member G. In the embodiment of FIG. 9, carrier ring 60 slides on rollers 62 relative to annular member G. Passenger containment means D′ is provided by passenger containment units 64 in the form of cars, seats, or chairs, etc., pivotably mounted to ring 60 by means of a swivel mount 65. Alternately, as can best be seen in FIG. 10, a ring rail 60′ may be rotatably and slidably mounted in the top of an annular member G′ by means of rollers 62′. Containment means D″ is provided by passenger containment units 64′ in the form of cars, seats, chairs, etc., suspended from rail 60′ in a pivotable manner by a swivel mount 65′. It is to be understood, of course, that containment units 64,64′ may be affixed to the carrier ring as well as pivotably mounted. By weighting a section 68 of carrier rings 60,60′, the slidable carrier ring will always pull toward the lowest point of annular passenger carrier G,G′ as a result of the wobbling or other prescribed motion imparted to the annular passenger carrier. Depending on the type mounting of passenger containment units 64,64′ to ring frame 60,60′, the containment units may have a separate resultant motion relative to the annular passenger carrier. Thus, annular housing A, may be in the form of a single lower or upper annular passenger carrier with a carrier ring 60 or 60′, respectively, concentrically rotatably mounted with respect to the carrier. Alternately, a single annular passenger carrier may be utilized with passenger containment means individually fixed, pivotably, or slidably attached to the annular carrier rather than by a second ring which carries the containment means in common described by the foregoing.

Thus, it can be seen that an advantageous construction can be had for an amusement park ride constructed according to the invention wherein an annular housing for passengers can be provided which undergoes various motions and visual effects to produce a highly exciting amusement ride. The motion of the annular passenger housing and the guidance of the passenger cars, or other passenger containment means inside the housing may be constructed and arranged to provide a wide variety of resultant movements and simulations for passengers of the ride without departing from the broad principles of the invention.

While a preferred embodiment of the invention has been described using specific terms, such description is for illustrative purposes only, and it is to be understood that changes and variations may be made without departing from the spirit or scope of the following claims.

What is claimed is:

1. An amusement ride comprising:

a central tower having a base;

an annular passenger housing surrounding said central tower in which passengers are accommodated;

passenger containment means carried by said annular housing for containing passengers at locations within said passenger housing;

connector means interconnecting said annular passenger housing and said central tower;

drive means operatively connected to said tower for raising and lowering said annular housing along an operational height of said tower in ascending and descending vertical motions while said passengers are contained at said locations within said passenger housing; and helix guidance means operatively connected between said tower and said annular housing causing said annular housing to rotate relative to said tower as it moves in said vertical motions.

2. The apparatus of claim 1 wherein said helix guidance means comprises a helix carried by said tower means, and follower means carried by said annular housing which engages and follows said helix to cause said housing to rotate.

3. The apparatus of claim 2 wherein said helix is configured to rotate said annular housing less than a complete revolution.

4. The apparatus of claim 1 wherein said helix guidance means comprises selectively engageable follower means operatively connected between said tower and annular housing by which said helix guidance means may be engaged and disengaged so that said annular housing may selectively driven in rotary and non-rotary motion relative to said tower.

5. The apparatus of claim 1 wherein said annular passenger housing includes a generally closed housing in which said passengers are contained, and includes transparent window means carried around a periphery of said annular passenger housing facing radially outward from said central tower through which said passengers may view an outside environment.

6. The apparatus of claim 1 where said connector means is constructed and arranged to limit motion of said annular passenger housing generally to a vertical motion in a vertical plane and rotary motion in a horizontal plane.

7. The apparatus of claim 1 wherein said drive means comprises fluid drive means which pushes said annular passenger housing vertically under the force of a fluid.

8. The apparatus of claim 7 including assist means for assisting the start of said annular passenger housing in an ascending motion as it moves vertically relative to said tower.

9. The apparatus of claim 8 wherein said assist means comprises a biasing means which biases said annular passenger housing upwardly to offset the weight of said housing as it ascends along said portion of said vertical tower.

10. The apparatus of claim 1 wherein said annular passenger housing is circular.

11. The apparatus of claim 1 including mounting means for mounting said passenger containment means for movement relative to said annular passenger housing.

12. The apparatus of claim 11 wherein said containment means comprises passenger seats in which said passengers are located and contained.

13. The apparatus of claim 12 wherein said annular passenger housing is enclosed.

14. The apparatus of claim 1 comprising simulation means for simulating a visual representation that said annular passenger housing is riding atop a visible fluid medium during said vertical motions.

15. The apparatus of claim 1 wherein said drive means comprises a cable connected to said annular passenger housing, pulley means carried above said tower receiving said cable, and winch means for retracting and extending said cable to raise and lower said annular passenger housing respectively.

16. The apparatus of claim 15 including a movable ring rotatably carried atop said tower, said pulley means being carried by said movable ring to allow said annular passenger housing to rotate about said tower.

17. An amusement ride comprising:

a central tower having a base;

a continuous annular passenger carrier surrounding said central tower for carrying passengers;

a space defined between said annular member and said central tower which permits said annular member to be driven in a wobbling motion relative to said central tower;

passenger containment means carried by said annular passenger carrier for containing passengers at locations about said annular passenger carrier; and drive means for moving said annular passenger carrier over an operational height of said tower in vertical movements and for imparting a wobbling motion to said passenger carrier relative to said tower.

18. The apparatus of claim 17 wherein said annular passenger carrier includes a continuous annular member carried by said tower, a carrier ring concentrically carried by said annular member, and means for carrying said carrier ring for relative rotation with respect to said annular member.

19. The apparatus of claim 18 wherein said passenger containment means includes individual passenger containment units which carry said passengers, and including means for suspending said passenger containment units from said carrier ring which is overhead of said passengers.

20. The apparatus of claim 19 wherein said passenger containment units are suspended from said carrier means in a pivotable manner.

21. The apparatus of claim 18 wherein said passenger containment means includes individual passenger containment units which carry said passengers, and including means for affixing said passenger containment units to said carrier ring in an upright position.

22. The apparatus of claim 21 wherein said passenger containment units are mounted to said carrier ring in a pivotable manner.

23. The apparatus of claim 18 including weight means carried by said carrier ring for causing said carrier ring to move toward a low side of said annular frame as said annular passenger carrier is driven in said wobbling motion.

24. The apparatus of claim 17 including rotary means for imparting a rotary motion to said annular passenger carrier relative to said tower.

25. The apparatus of claim 17 wherein said drive means includes means for suspending said annular passenger carrier from said tower generally in a non-contacting manner, and spaced from said tower a sufficient distance so that said annular passenger carrier may be moved in a wobbling motion having 3-degrees of freedom.

26. The apparatus of claim 17 wherein said annular passenger carrier includes a track, and said passengers containment means includes passenger cars which are guided by said track.

27. The apparatus of claim 26 wherein said annular passenger carrier includes an annular passenger housing in which said track is generally enclosed.

28. The apparatus of claim 26 wherein said annular passenger housing is circular and said track is circular and concentric with said annular passenger housing.

29. The apparatus of claim 26 wherein said annular passenger carrier includes a polygonal passenger housing and said track includes generally straight track sections terminating at vertices of said polygonal housing.

30. The apparatus of claim 17 including means for attaching said containment means to said annular passenger carrier for providing movement relative to said annular passenger carrier as a result of said movement of said annular passenger carrier.

31. The apparatus of claim 30 wherein said drive means includes generally flexible cable means suspending said annular passenger carrier from said tower, said cable means being connected to said annular passenger carrier at selected attachment points about a periphery of said annular passenger carrier, and programmable drive means which extends and retracts said cable means at prescribed rates to impart said vertical and wobbling motions to said annular passenger carrier.

32. The apparatus of claim 17 wherein said drive means includes generally flexible cable means suspending said annular passenger carrier from said tower, said cable means being connected to said annular passenger carrier at selected attachment points about a periphery of said annular passenger carrier, and programmable drive means which extends and retracts said cable means at prescribed rates to impart said vertical and wobbling motions to said annular passenger carrier.

33. An amusement ride comprising:

a central tower;

an annular passenger carrier surrounding said central tower for carrying passengers;

movable passenger containment means carried by said annular passenger carrier for movement relative to said annular passenger carrier for containing and carrying passengers;

means for attaching said passenger containment means to said annular passenger carrier for relative movement therebetween;

guide means for guiding said passenger containment means for movement along a prescribed path relative to said annular passenger carrier in response to movement of said annular passenger carrier; and drive means for imparting a prescribed motion to said annular passenger carrier relative to said tower to impart a resultant movement to said passenger containment means relative to said annular passenger carrier.

34. The apparatus of claim 33 wherein said drive means includes means for imparting a wobbling motion to said passenger carrier means having three degrees of freedom.

35. The apparatus of claim 33 wherein said drive means comprises a cable connected to said annular passenger carrier, pulley means carried above said tower receiving said cable, and winch means for retracting and extending said cable to raise and lower said annular passenger carrier respectively.

36. The apparatus of claim 35 comprising motor means for driving said winch means at different speeds to tilt said annular passenger carrier relative to said tower in a programmed manner.

37. The apparatus of claim 36 including a movable ring rotatably carried atop said tower, said pulley means being carried by said movable ring, and ring drive means for rotating said ring atop said tower to cause said annular passenger carrier to rotate about said tower.

38. The apparatus of claim 33 wherein said containment means comprises movable passenger cars in which said passengers are located and contained.

39. The apparatus of claim 38 wherein said annular passenger carrier is circular and said guide means includes a continuous track which provides for arcuate movement of said cars around the circumference of said annular passenger carrier within said interior of said passenger carrier.

40. The apparatus of claim 38 wherein said annular passenger carrier is polygonal and said guide means comprises a track for guiding said cars in linear motion between vertices of said polygonal passenger carrier.

41. The apparatus of claim 33 wherein said annular passenger carrier includes a continuous annular member carried by said tower, and said guide means includes a carrier ring concentrically carried by said annular member, and slidable mounting means for carrying said carrier ring for relative rotation with respect to said annular member.

42. The apparatus of claim 41 wherein said passenger containment means includes individual passenger containment units which carry said passengers, and including means for suspending said passenger containment units from said carrier ring which is overhead of said passengers.

43. The apparatus of claim 42 wherein said passenger containment units are suspended from said carrier means in a pivotable manner.

44. The apparatus of claim 41 wherein said passenger containment means includes individual passenger containment units which carry said passengers, and including means for affixing said passenger containment units to said carrier ring in an upright position.

45. The apparatus of claim 44 wherein said passenger containment units are mounted to said carrier ring in a pivotable manner.

46. The apparatus of claim 41 including weight means carried by said carrier ring for causing said carrier ring to move toward a low side of said annular frame as said annular passenger carrier is driven in said wobbling motion.

47. An amusement ride comprising:

a central tower having a base supporting said tower vertically;

an annular member surrounding said central tower in a concentric manner;

a space defined between said annular member and said central tower which permits said annular member to be suspended from said central tower and driven in a wobbling motion relative to said central tower having at least two degrees of freedom;

a carrier ring slidably carried by said annular member;

passenger containment means carried by said carrier ring for carrying and containing passengers; and drive means for imparting a prescribed motion to said annular member relative to said central tower to impart a resultant movement to said passenger containment means relative to said annular member.

48. The apparatus of claim 47 including weight means carried by said carrier ring for causing said carrier ring to move toward a low side of said annular member as said annular passenger carrier is driven in said wobbling motion.

49. The apparatus of claim 47 wherein said passenger containment means are pivotable attached to said carrier ring.

50. The apparatus of claim 47 wherein said passenger containment means is carried underneath said carrier ring.

51. An amusement ride comprising:

a central tower having a base;

an annular passenger housing surrounding said central tower in which passengers are accommodated;

passenger containment means carried by said annular housing for containing passengers at locations within said passenger housing;

connector means interconnecting said annular passenger housing and said central tower;

drive means operatively connected to said tower annular housing for repeatedly raising and lowering said annular housing along an operational height of said tower in ascending and descending repeated reciprocal vertical motions during said ride while said passengers are contained at said locations within said passenger housing; and rotary means for rotating said annular passenger housing as said annular passenger housing moves in said repeated reciprocating vertical motions.

52. The apparatus of claim 51 including simulation means for simulating a visual representation that said annular passenger housing is riding atop a visible fluid medium during said repeated vertical motions; and said simulation means producing an effect that said annular passenger housing is dancing up and down on said fluid medium as said annular passenger housing is moved by said drive means.

53. The apparatus of claim 51 wherein said rotary means rotates said annular passenger housing in reversing rotational motions during said reciprocating vertical motions along said operation heights of said tower.

54. An amusement ride comprising:

a central tower having a base;

an annular passenger housing surrounding said central tower in which passengers are accommodated;

passenger containment means carried by said annular housing for containing passengers at locations within said passenger housing;

connector means interconnecting said annular passenger housing and said central tower;

drive means for raising said annular passenger housing along an operational height of said tower in an ascending generally non-rotating vertical motion during said ride while said passengers are contained at said locations within said passenger housing; and rotary means for rapidly rotating said annular passenger housing in rapid rotational motions as said annular passenger housing descends in said vertical motions.

55. The apparatus of claim 54 wherein said rotary means is selectively engageable so that said rotary means may be disengaged while said annular passenger housing ascends under said fluid force generally without rotation, and may be engaged so that said annular passenger housing rotates relative to said central tower while descending.

56. The apparatus of claim 54 wherein said drive means comprises fluid drive means which pushes said annular passenger housing vertically under the force of a fluid.

57. The apparatus of claim 56 wherein said rotary means includes selectively engageable follower means operatively connected between said tower and annular passenger housing by which said helix guidance means may be disengaged so that said annular passenger housing may ascend in a nonrotary motion under said fluid force and may be engaged so that said annular passenger housing may descend under gravitational forces with rotary motion relative to said tower.

* * * * *